US005112060A

United States Patent [19]

Jones

[11] Patent Number: 5,112,060

[45] Date of Patent: May 12, 1992

[54] GAMING TABLE APPARATUS

[76] Inventor: Daniel A. Jones, 5520 Del Rey Ave., Las Vegas, Nev. 89102

[21] Appl. No.: 701,670

[22] Filed: May 16, 1991

[51] Int. Cl.[5] ..... A63F 9/00

[52] U.S. Cl. ..... 273/309; 273/148 R

[58] Field of Search ..... 273/309, 148 R, 85 CP, 273/274

[56] References Cited

U.S. PATENT DOCUMENTS

| | | | |
|---|---|---|---|
| 4,518,001 | 5/1985 | Branham | 133/5 |
| 4,614,342 | 9/1986 | Takashima | 273/85 CP |
| 4,861,041 | 8/1989 | Jones et al. | 273/292 |

OTHER PUBLICATIONS

Asahi Seiko Catalog No. AV89C, 8/20/89; p. 44.
Asahi Seiko Catalog No. AV89C, 8/20/89; p. 51.

*Primary Examiner*—Benjamin Layno
*Attorney, Agent, or Firm*—Quirk, Tratos & Roethel

[57] ABSTRACT

A gaming table is provided with a coin slot and a coin detector at each of a plurality of player locations. Each coin slot and coin detector is connected to a conduit that leads to a hopper on the interior of the gaming table. The hopper collects each coin that is dropped into the coin slot and passes through the coin detector during the play of the game. The hopper includes a dispensing escalator arm that communicates with a chip rack in the surface of the gaming table. An electronic control system is provided associated with the hopper so that a dealer may remotely activate the hopper to dispense coins from the hopper into the chip rack when it is desired to refill the chip rack with coins for use during the play of the game.

15 Claims, 2 Drawing Sheets

GAMING TABLE APPARATUS

This invention relates to a gaming table, and more particularly to a gaming table including a coin hopper and a modified chip rack for recirculating tokens used in the play of the game back to the chip rack for further use.

BACKGROUND OF THE INVENTION

A conventional gaming table used for playing Twenty-One and other similar casino games has a plurality of player locations around the outer periphery of the table and a dealer's location located generally opposite the player locations. From the dealer's location, the dealer of the game effects the operation of the game including dealing of the cards, paying winning wagers and collecting losing wagers.

One important function performed by the dealer is making change for the players. Most casinos would prefer that the players use tokens or chips to make their wagers, rather than currency. The player generally obtains the tokens or chips from the dealer in exchange for currency and all winning wagers are paid in tokens or chips.

A conventional gaming table has a chip rack located adjacent the dealer's location which is filled with the various denomination of tokens or chips that are used in the game. As the game proceeds, losing wagers that are collected are placed in the chip rack and winning wagers are paid using these same chips.

During the course of play, the chip rack may run low and the house performs a "fill" of the chip rack. This entails security and supervisory personnel to obtain the necessary variety of tokens or chips needed and to bring them to the dealer for the filling of the chip rack. In order to maintain accounting requirements and to ensure proper auditing and security, the game must be interrupted while the fill is taking place. The dealer verifies the amount of tokens or chips that are being placed in the chip rack and both the dealer and the supervisory personnel sign receipts acknowledging that a fill has taken place. While casino personnel are generally well versed in the procedures involved in making a fill, the procedure can take as much as five minutes and is most distracting and disruptive to the players.

Because of this inconvenience, casinos would prefer to keep the time disruptions for fills to a minimum and a typical Twenty-One game will only require a fill on the average of every two hours. The size of the chip rack is limited by the size of the table and by security requirements limiting the amount of chips that are exposed in the chip rack due to the fact that the chips have monetary value.

Casino games have been developed that utilize tokens or chips that are placed into a coin slot in the surface of the gaming table to indicate that the player is participating in the game or a particular feature of the game. For example, U.S. Pat. No. 4,861,041, Jones et al., discloses a method of progressive jackpot gaming that involves a typical casino or cardroom game modified to include a progressive jackpot component. During the play of a Twenty-One game, for example, in addition to his normal wager, a player will have the option of making an additional wager that becomes part of, and makes the player eligible to win, the progressive jackpot. If the player's Twenty-One hand comprises a particular, predetermined arrangement of cards, the player will win all or part of the amount showing on the progressive jackpot. This progressive jackpot feature is also adaptable to other casino or cardroom games such as Draw Poker, Stud Poker, Lo-Ball Poker or Caribbean Stud ® Poker.

The apparatus used in this type of game comprises a gaming table, such as those used for Twenty-One or poker, modified with the addition of a token, chip or coin slot that is electronically connected to a progressive jackpot meter. When a player drops a token, chip or coin into the coin slot and it is recognized by a coin detection device, a light is activated at the player's location indicating that he is participating in the progressive jackpot component of the game during that hand. At the same time, a signal from the coin detector is sent to the progressive meter to increment the amount shown on the progressive meter. At the conclusion of the play of each hand, the coin detector is reset for the next hand. When a player wins all or part of the progressive jackpot, the amount showing on the progressive jackpot meter is reduced by the amount won by the player. The disclosure of U.S. Pat. No. 4,861,041 is hereby incorporated by reference.

The token, chip or coin that is placed into the coin slot and passes through the coin detector falls down a conduit and into a bucket placed on the interior of the gaming table. At designated times during the day, casino personnel collect the tokens, chips or coins that have fallen into the bucket and the empty bucket is replaced on the interior of the gaming table.

The players will purchase the tokens, chips or coins that are used in the coin slot from the dealer who maintains his supply of these tokens, chips or coins in the chip rack. However, unlike during the play of the regular game in which tokens or chips are continually cycling into and out of the chip rack as the players win or lose, the tokens, chips or coins used in the coin slots only come out of the chip rack. The wagered tokens, chips or coins placed into the coin slot fall into the buckets on the interior of the gaming table and are not available for recycling back to the player.

Whatever supply of tokens, chips or coins is initially available in the chip rack for use in the coin slots will be quickly exhausted and the casino personnel will be required to effect a "fill" of the chip rack to replenish the supply. Fills will be much more frequent in this type of game causing additional inconvenience to the players and to the casino which must interrupt the game to effect the fill.

It is an object of the present invention to provide an apparatus that allows for the recycling of the tokens, chips or coins that are used in the play of a live casino table game.

It is a feature of the present invention to provide an apparatus that collects wagered tokens, chips or coins that are dropped through a coin slot on the surface of a gaming table and a control system that allows the collection device to be activated to feed these tokens, chips or coins back into the chip rack as needed to refill the chip rack.

It is a further feature of the invention to provide a modified chip rack that can receive tokens, chips or coins fed to the chip rack from a collection device located on the interior of the gaming table.

It is an advantage of the present invention that the need for frequent fills of the chip rack can be minimized in live casino table games that utilize tokens, chips or coins dropped through a coin slot in the surface of the gaming table during the play of the game. The house will experience a savings in personnel time since the need for numerous fills will be eliminated. The house will also experience a savings in connection with the expense of the paperwork processing associated with each fill including internal accounting personnel time and the cost of the fill slips themselves, which must be on a form approved by the gaming authorities for the jurisdiction involved.

It is a further advantage of the present invention that a supply of tokens, chips or coins that are used in the coin slot on the surface of the gaming table is always available to the dealer without the necessity of the casino personnel undertaking the steps necessary to coordinate a "fill" of the chip rack.

SUMMARY OF THE INVENTION

A gaming table is provided with a coin slot and a coin detector at each of a plurality of player locations. Each coin slot and coin detector is connected to a conduit that leads to a hopper on the interior of the gaming table. The hopper collects each coin that is dropped into the coin slot and passes through the coin detector during the play of the game. The hopper includes a dispensing escalator arm that communicates with a chip rack located in the surface of the gaming table. An electronic control system is provided associated with the hopper so that a dealer may remotely activate the hopper to dispense coins from the hopper into the chip rack when it is desired to refill the chip rack with coins for use during the play of the game.

DETAILED DESCRIPTION OF THE PREFERRED EMBODIMENTS

Figure 1:
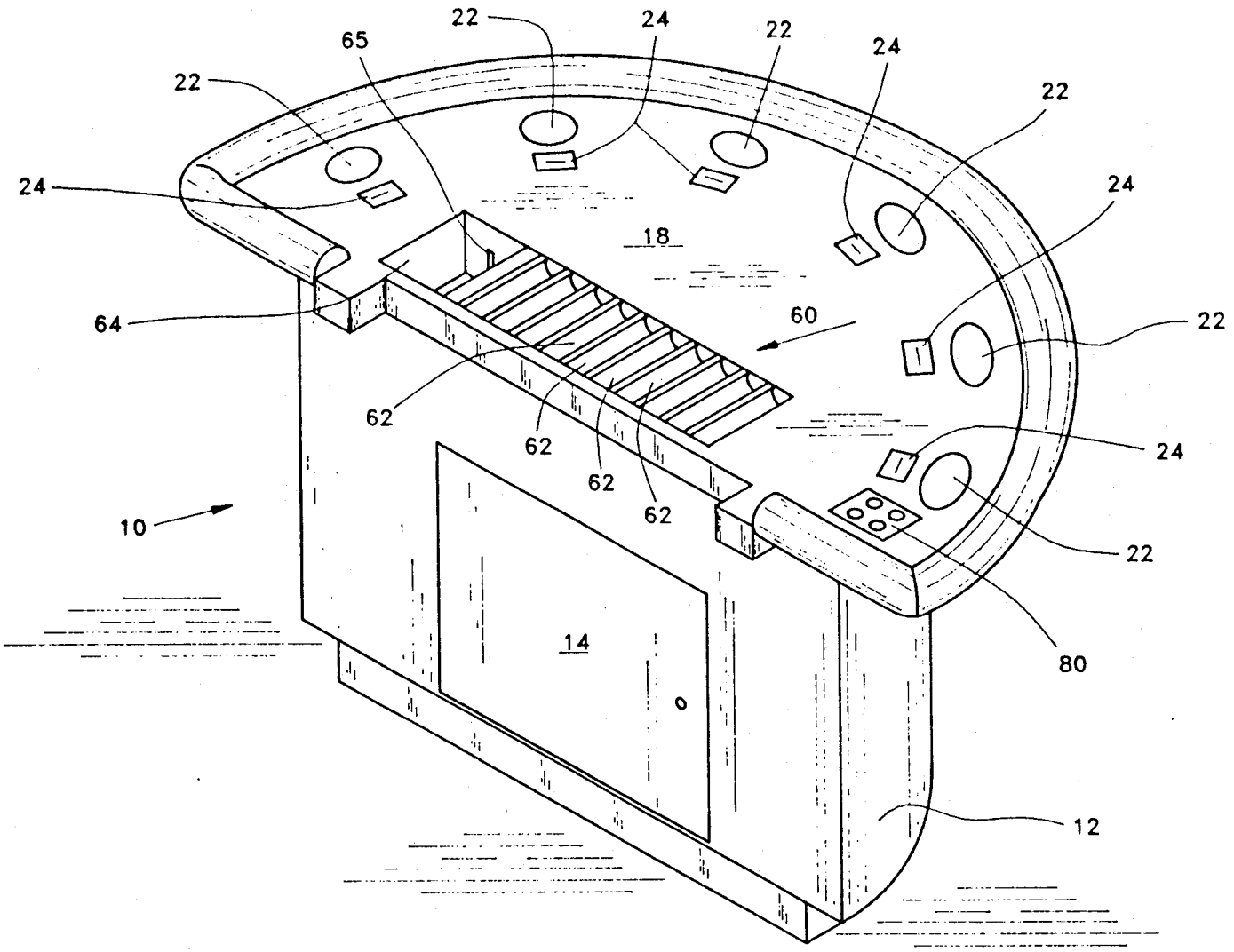
FIG. 1 shows a perspective view of a gaming table embodying the present invention with the interior of the gaming table not shown.

The gaming table modified in accordance with the present invention is shown generally at 10 in FIG. 1. The gaming table 10 includes a conventional gaming table base 12 which is normally hollow on the interior thereof underneath the gaming table top 18. Access to the interior of the gaming table base 12 is by way of a lockable door 14.

The gaming table top 18 includes a plurality of player locations 22 distributed around the periphery of the gaming table 10 in a conventional arrangement. Each player location 22 is provided with an associated coin slot 24. The coin slot 24 is used whenever a game is played that allows or permits the players to make an extra wager during the game so that the extra wager is added to a progressive jackpot.

Representative of a game that allows or permits the players to make an extra wager during the game so that the extra wager is added to a progressive jackpot is that described in U.S. Pat. No. 4,861,041 to Jones and Suttle.

Figure 2:
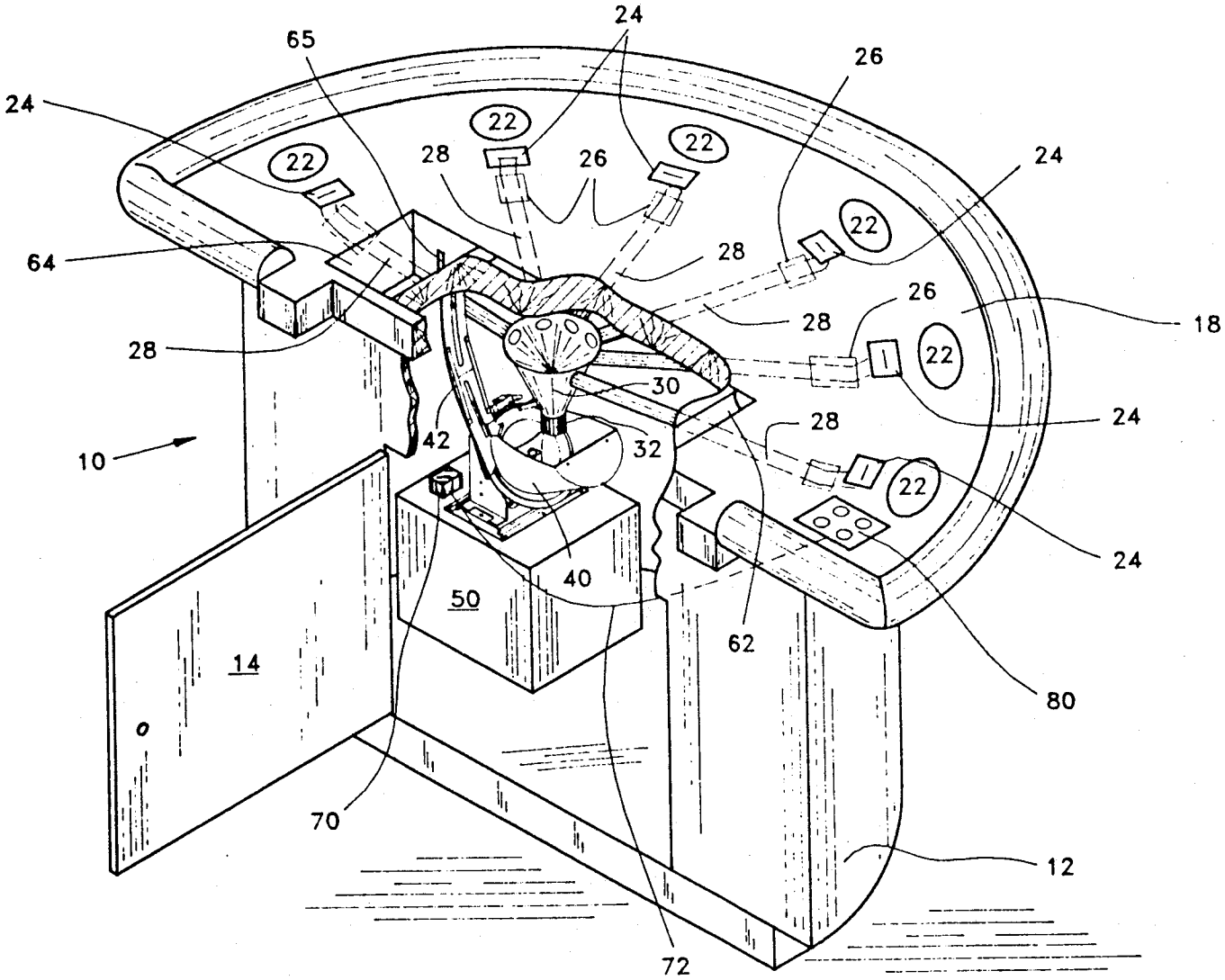
FIG. 2 shows a perspective view of a gaming table embodying the present invention partly in section showing the interior of the gaming table.

Positioned immediately below each coin slot 24 is a token or coin detection device 26 (see FIG. 2) that is used to determine whether a token or coin has been inserted into the coin slot 24 by a player. If metallic coins or tokens are used, the coin detection device should preferably determine whether the coin or token is legitimate and not counterfeit or a slug. An appropriate coin detector for this purpose is the Coin Comparitor® coin acceptor Model No. CC-40 distributed by Coin Mechanisms, Inc., Elmhurst, Illinois 60126-1184. If nonmetallic tokens are used, such as casino chips, it is preferred to simply utilize an optical detector positioned just below the coin slot 24 that merely senses that a casino chip has been dropped into the coin slot.

After the token or coin falls through the coin detector 26, it passes through a conduit 28 and into the funnel cone 30. The funnel spout 32 of the funnel cone 30 is positioned above a hopper 40 at approximately the center of the interior of the gaming table 10. If desired, the hopper 40 can be mounted above the floor surface on a support stand 50 or other suitable support.

The hopper 40 can be any suitable hopper designed to handle whatever denomination of the tokens or coins are being used to play the game. A preferred hopper 40 is a conventional escalator coin hopper, such as Model No. CH-500/U1 or Model No. DH-750/U1 available from Asahi Seiko USA, Inc., 4029 S. Industrial Road, Las Vegas, NV 89103 and similar to the escalator hopper disclosed in U.S. Pat. No. 4,518,001 (Branham), the disclosure of which is incorporated herein by this reference. Each token or coin that is placed by a player into the coin slot 24 passes through the conduit 28, through the funnel cone 30 and the funnel spout 32 and is stored in the hopper 40. The hopper 40 communicates by way of the escalator arm 42 with the chip rack 60.

The chip rack 60 includes a plurality of chip rows 62 arranged side by side which are accessible to the dealer and from which the money transactions are made that occur during the normal play of the game such as the payouts, collections and changing of currency. Typically, a chip rack 60 has chip rows 62 assigned for the different denominations of tokens or coins that are used in the game.

The chip rack 60 of the present invention has been modified to include a chip bin 64 at one end of the chip rack 60 which communicates by way of a coin entry slot 65 with the top end of the escalator arm 42 of the hopper 40. Whenever the chip rack 60 begins to run low on the tokens or coins that are used in the coin slot 24, the dealer can obtain a resupply of tokens or coins from the hopper 40.

An electronic control system is utilized to control the activation of the hopper 40 to resupply tokens or coins to the dealer. A control panel 80 is provided on the gaming table top 18 of the gaming table 10 and connected by wiring 72 to the control unit 70 positioned adjacent to the hopper 40. The control unit 70 includes a microprocessor that is programmed to generate an electronic signal to the hopper 40 whenever it is desired to activate the hopper 40 to dispense tokens or coins to the chip bin 64. The dealer simply depresses a button on the control panel 80 and the hopper 40 is activated to dispense tokens or coins up the escalator arm 42 and through the chip entry slot 65 and into the chip bin 64. The dealer can then manually move the tokens or coins from the chip bin 64 and into the designated chip rows 62 in the chip rack 60 for that denomination of tokens or coins.

In the preferred embodiment of the present invention, the control panel 80 will be programmed to dispense one or more of a predetermined number of tokens or coins, say 20, 40 or 60, so that accounting of the number of tokens or coins that have been refilled into the chip rack 60 can be easily obtained. In the typical configuration of the invention, the players will insert quarters, dollars or dollar tokens into the coin lot 24 to be eligible to participate in the jackpot feature of the game being played. The hopper will be designed to dispense quarters, dollars or dollar tokens into the chip bin 64 whenever the chip row 62 that is allocated for quarters or dollars runs low and the dealer needs a resupply.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A gaming table comprising:

a) a gaming table base having a hollow interior, b) a coin hopper positioned on the interior of the gaming table, c) a gaming table top mounted on the gaming table base and including at least one player location provided with a coin slot adjacent thereto, d) a conduit extending from the coin slot to the coin hopper on the interior of the gaming table, e) a chip rack mounted in the gaming table top, the chip rack including at least one chip row and a chip bin, f) the hopper including a coin storage area and an escalator arm extending from the coin storage area of the hopper to the chip bin in the chip rack whereby coins from the hopper can be recycled into the chip bin whenever the coin supply in the chip rack runs low.

2. The gaming table of claim 1 further including a plurality of player locations arranged around a periphery of the gaming table top, each player location having a coin slot and a conduit extending from each coin slot to the coin storage area in the hopper on the interior of the gaming table.

3. The gaming table of claim 2 further including a funnel interposed between each conduit and the coin storage are of the hopper to direct the coins into the coin storage area of the hopper.

4. The gaming table of claim 1 further including a support stand on the interior of the gaming table and the hopper being mounted on the support stand so that the exit slot on the escalator arm of the hopper can be positioned at the appropriate height adjacent the coin entry slot of the chip bin.

5. The gaming table of claim 1 further including a control system for dispensing coins from the hopper comprising a control panel mounted in the surface of the gaming table top and a control unit connecting the control panel to the hopper whereby when the control panel is activated by the dealer, the hopper dispenses a predetermined number of coins into the chip bin.

6. The gaming table of claim 1 further including a coin detector adjacent each coin slot to determine whether a coin has been inserted into the coin slot.

7. A gaming table comprising:

a) a gaming table, b) a coin hopper positioned adjacent the gaming table, c) the gaming table including at least one player location provided with a coin slot adjacent thereto, d) a conduit extending from the coin slot to the coin hopper, e) a chip rack mounted in the gaming table, f) the hopper including a coin storage area and an escalator arm extending from the coin storage area of the hopper to the chip rack whereby coins from the hopper can be recycled to the chip rack whenever the coin supply in the chip rack runs low.

8. The gaming table of claim 7 further including a plurality of player locations arranged around a periphery of the gaming table, each player location having a coin slot and a conduit extending from each coin slot to the coin storage area of the hopper.

9. The gaming table of claim 8 further including a funnel interposed between each conduit and the coin storage area of the hopper to direct the coins into the coin storage area of the hopper.

10. The gaming table of claim 7 further including a control system for dispensing coins from the hopper comprising a control panel mounted adjacent the gaming table and a control unit connecting the control panel to the hopper whereby when the control panel is activated by the dealer, the hopper dispenses a predetermined number of coins into the chip bin.

11. The gaming table of claim 7 further including a coin detector adjacent each coil slot to determine whether a coin has been inserted into the coin slot.

12. A gaming table comprising:

a) a gaming table base having a hollow interior, b) a coin hopper positioned on the interior of the gaming table, c) a gaming table top mounted on the gaming table base and including at least one player location provided with a coin slot adjacent thereto, d) means for delivering coins placed in the coin slot to the coin hopper on the interior of the gaming table, e) means for storing coins on gaming table top, f) means for dispensing coins from the coin hopper to the coin storage means, and g) a control system for dispensing coins from the hopper comprising a control panel mounted in the surface of the gaming table top and a control unit connecting the control panel to the hopper whereby when the control panel is activated by the dealer, the hopper dispenses a predetermined number of coins into the coin storage means whereby coins from the hopper can be recycled to the gaming table whenever the supply in the coin storage means runs low.

13. The gaming table of claim 12 further including a plurality of player locations arranged around a periphery of the gaming table top, each player location having a coin slot and means for delivering coins from each coin slot to the hopper on the interior of the gaming table.

14. The gaming table of claim 13 further including a funnel interposed between the coin delivering means and the hopper to direct the coins into the hopper.

15. The gaming table of claim 12 further including a coin detection means adjacent each coin slot to determine whether a coin has been inserted into the coin slot.

* * * * *